United States Patent [19]

Wagner

[11] Patent Number: 4,709,850

[45] Date of Patent: Dec. 1, 1987

[54] MAILER INCLUDING RETURN ENVELOPE AND REMITTANCE STUB COMBINED IN OUTER ENVELOPE

[75] Inventor: David G. Wagner, Amherst, N.Y.

[73] Assignee: Moore Business Forms, Inc., Grand Island, N.Y.

[21] Appl. No.: 841,814

[22] Filed: Mar. 20, 1986

[51] Int. Cl.[4] ..... B65D 27/10; B65D 27/06; B65D 27/34

[52] U.S. Cl. ..... 229/73; 229/69; 206/610

[58] Field of Search ..... 229/73, 69, 92.1, 70; 206/610

[56] References Cited

U.S. PATENT DOCUMENTS

| | | | |
|---|---|---|---|
| Re. 30,114 | 10/1979 | Juszak et al. | 229/69 |
| 2,983,525 | 5/1961 | Mercur | 282/25 |
| 3,133,752 | 5/1964 | Schumacher | 282/25 |
| 3,211,469 | 10/1965 | Chamberlain | 282/11.5 |
| 3,312,385 | 4/1967 | Amort | 229/73 |
| 3,411,699 | 11/1968 | Pine et al. | 229/69 |
| 3,428,237 | 2/1969 | Dowen | 229/69 |
| 3,507,519 | 4/1970 | McNabb | 282/25 |
| 3,905,545 | 9/1975 | Juszak et al. | 229/69 |
| 3,952,942 | 4/1976 | O'Leary et al. | 229/69 |
| 3,981,435 | 9/1976 | Johnsen | 229/69 |
| 4,055,294 | 10/1977 | Traise | 229/73 |
| 4,148,430 | 4/1979 | Drake | 229/69 |
| 4,384,670 | 5/1983 | Dicker | 229/69 |
| 4,487,360 | 12/1984 | Fisher et al. | 229/73 |

OTHER PUBLICATIONS

Moore Business Forms, Inc. Speedimailer® Business Form 225.

*Primary Examiner*—Willis Little

*Attorney, Agent, or Firm*—Cushman, Darby & Cushman

[57] ABSTRACT

For providing an improved mailer/return envelope/remittance stub assembled set in which the remittance stub and check may be inserted by the consumer in the return envelope without folding either of them, which return envelope and contents may be sorted and read, if desired, by automated machines, and as to the parts of which the business may use a combination if impact and non-impact printers to print variable information on the parts prior to assembly, and use a relatively inexpensive sealer for assembling the parts into sets, three parts are provided. Of these, Part 2 at one stage forms a first face of a mailer and at another a second face of a return envelope; Part 1 at that other stage forms the first face of the return envelope and the flap for sealing the open end of the return envelope; and Part 3 at the one stage forms the second face of the mailer and, at the other stage, forms the remittance stub.

31 Claims, 12 Drawing Figures

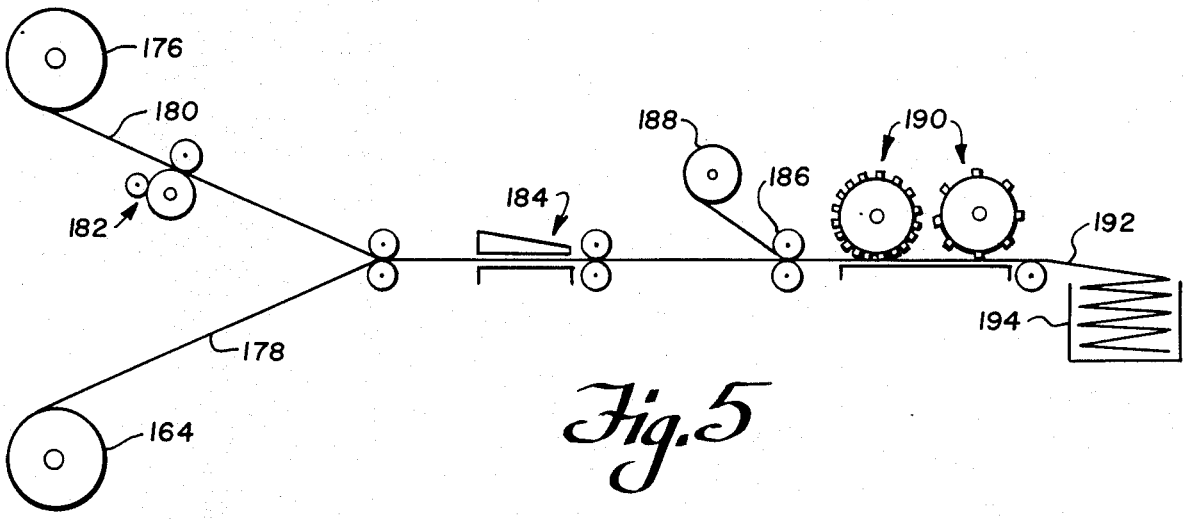
Fig. 5
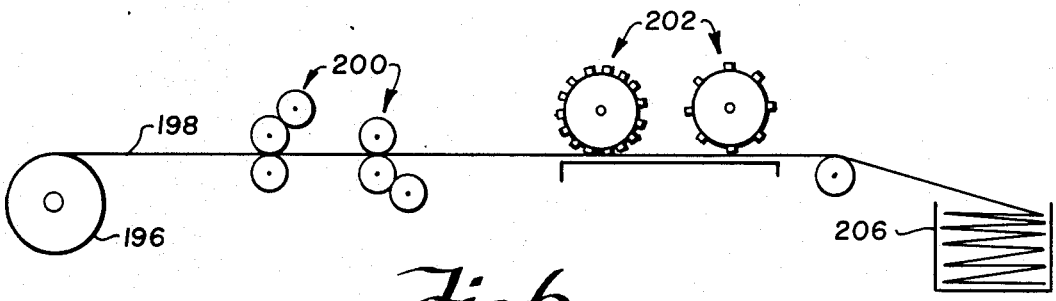
Fig. 6
Fig. 7
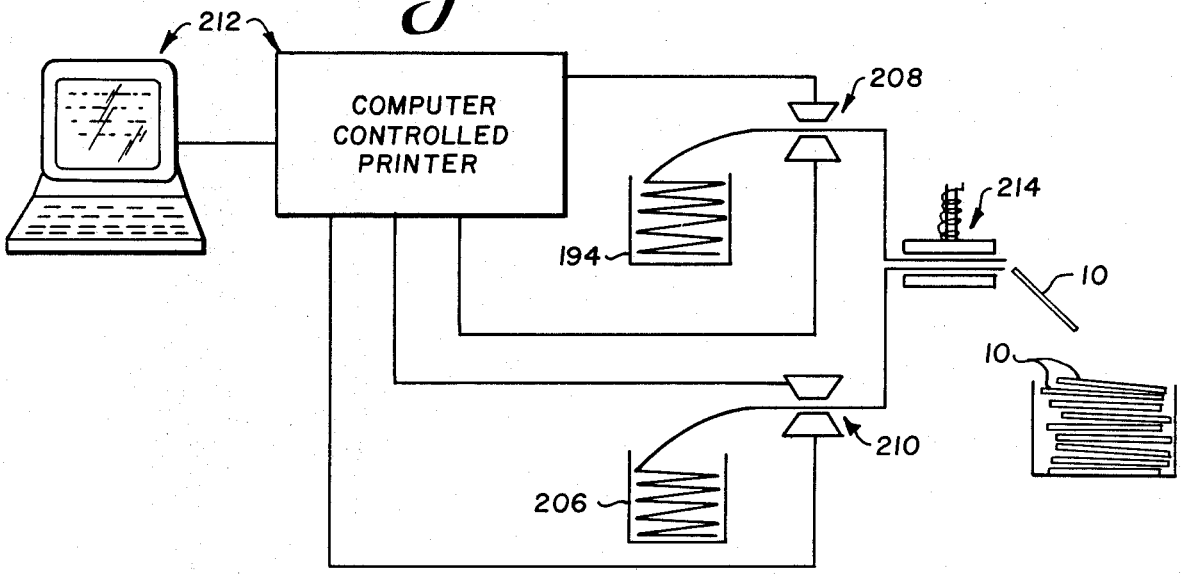

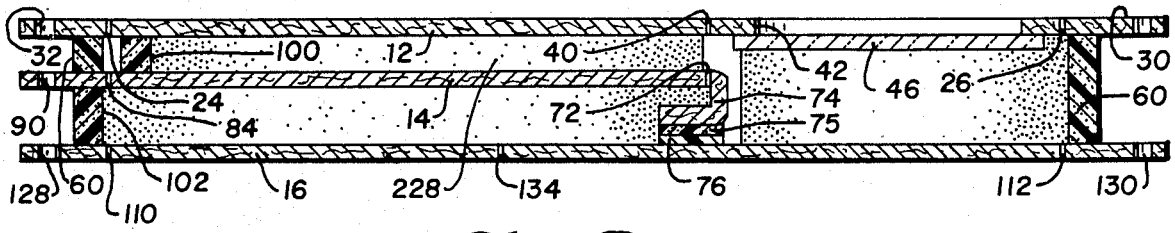
Fig. 8
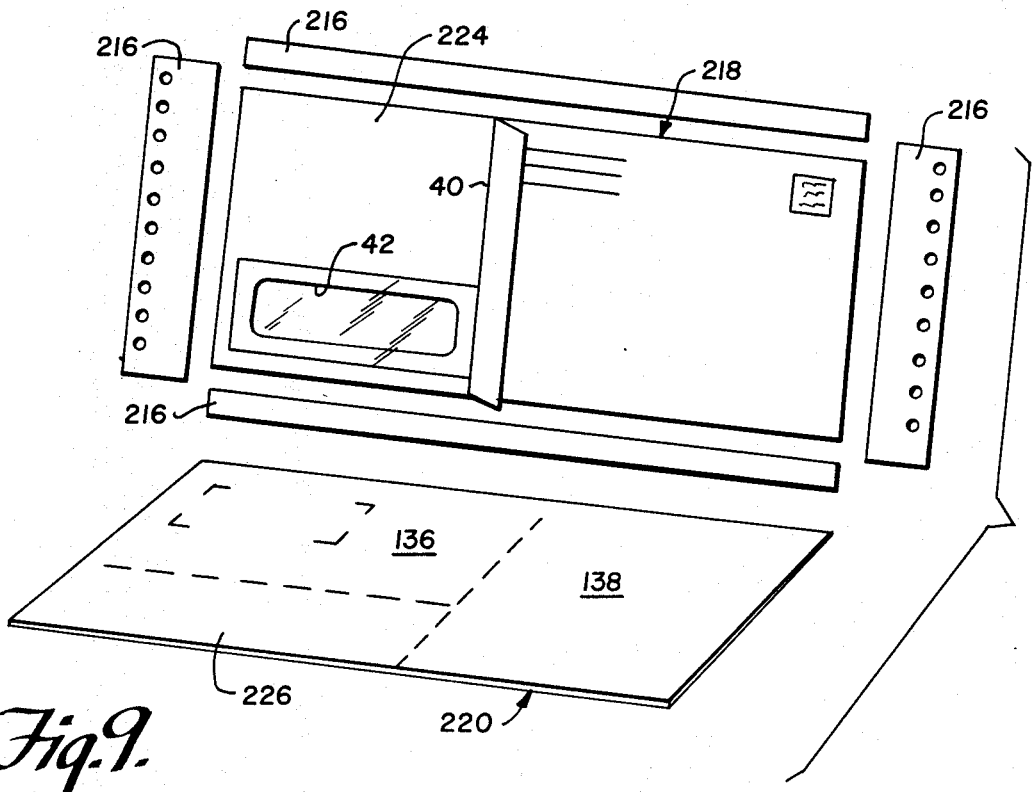
Fig. 9.
Fig. 10
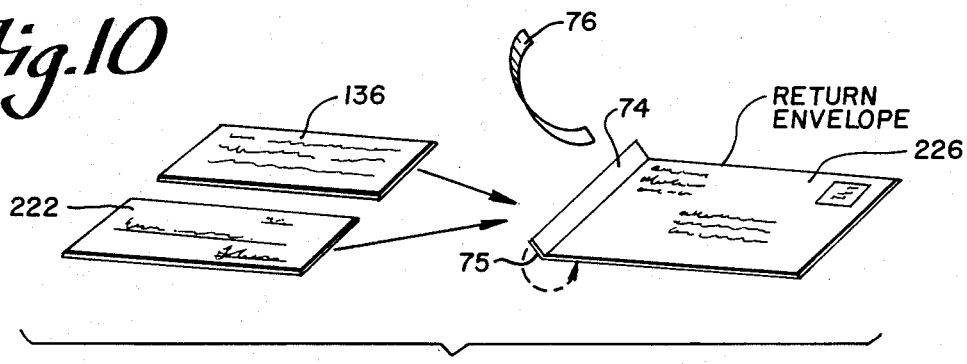

MAILER INCLUDING RETURN ENVELOPE AND REMITTANCE STUB COMBINED IN OUTER ENVELOPE

BACKGROUND OF THE INVENTION

As a consumer, e.g. of heating oil, dental services and the like, as a pledgee to various causes, and the like, it has become common for householders and other postal patrons to receive in the mail a multiple ply assembly, the outermost constituent of which is a mailing envelope used by the addressor for getting the mailing envelope contents expeditiously into the hands of the addressee.

Usually, such a filled mailing envelope (or "mailer") will have instructions or other indications about its periphery as to the steps to be taken by the addressee for opening the outer envelope in order to gain access to the contents. Typically, access is gained by tearing-off one or more marginal strips along perforated lines.

The contents of such a mailer typically include an invoice, bill, statement, pledge form or the like (often one which may be separated into one section to send back with a remittance, e.g. a "remittance stub", and another section as a personal record of having been billed and having paid, e.g. a "record of payment stub"), and a pre-addressed, often pre-stamped or franked return envelope.

The task of making a requested payment is thus considerably simplified for the addressee: open the mailer, withdraw its contents, write a check for an indicated amount, separate the remittance and record of payment stubs from one another, place the check and remittance stub in the return envelope, seal the latter and drop it in the mail.

Many utilitarian designs of such mailer assemblies are commercially available. However, for some situations, including those brought on by recent changes in other fields, an ideal mailer assembly has heretofore been unavailable.

In particular, the U.S. Postal Service, and other mail handling, processing and delivering agencies and companies, as well as the businesses which receive remittances, are placing more and more automated code and address readers into use, e.g. optical character readers ("OCR's"). Some of this equipment, and associated equipment used for high-speed automated sorting of mail is susceptible to malfunction, or cannot be used, where the return envelopes have closure flaps which seal on the front face, or the front face is otherwise partly obscured, where the return envelopes or remittance stubs are of an odd size, and/or where the remitter folds his or her check, and/or the remittance stub, and/or staples these two items together before placing them in the return envelope.

In further particular, the businesses which send out such mailer assemblies often receive the components in two, three or more parts on which the business may need to print variable information (such as names, addresses, account numbers, itemizations, amounts, catagory designators, telephone numbers, and the like) in various places on difference ones of the parts, before these parts can be assembled into mailers and sent out. Typically, if all of the variable information is not printed on the various parts simultaneously in one pass through a printer, then it is printed in two different ways and/or on two different printers, one of which may be an impact-type of printer with or without a ribbon, and another of which may be a nonimpact-type printer, such as a computer-controlled ink jet-type printer. One or more patches of one or more faces of one or more parts of such business forms may be coated with a "carbon" or carbonless microencapsulated ink formulation so as to permit certain information applied to the form, or to a subassembly thereof, by directly impacting one part, to become printed on a surface of an underlying part instead of or in addition to its becoming printed on the directly impacted surface. Where multiple plies must be brought together from various printing stations and manifolded, interleaved, connected at specified sites and the like, usually an item of apparatus known as a collator is needed by the business. However some businesses which could otherwise become good customers for business forms of the general type under description find the purchase or lease of a collator too steep an expense to justify, and so their growth and modernization in this facit is held-back.

Moore Business Forms, Inc., the current assignee of the invention disclosed herein, presently commercially offers a business form product under the trademark Lasermate TM which is designed for use with both impact-type and nonimpact type continuous forms printers. That Lasermate TM form set current is provided in two parts. Part 1 has die-cut(s) and window patches(es), a full perimeter pattern of hot melt reheatable adhesive, and necessary perforations at top, bottom, left, and right to comply with end usage requirements. Part 2 has perforations which match with Part 1 and, as required, extra internal perforations which define, and allow removal of a particular sized remittance stub and payment record stub. Forms processing includes printing of variable data on Part 2 when used with nonimpact printers, or Parts 1 and 2 if used with impact printers. Both parts are then collated, detached as individual sets, and sealed to provide a ready-to-mail piece. The product, as configured now, does not allow for a return envelope which would permit the end user to insert both remittance stub and check into the return envelope without folding.

SUMMARY OF THE INVENTION

For providing an improved mailer/return envelope/remittance stub assembled set in which the remittance stub and check may be inserted by the consumer in the return envelope without folding either of them, which return envelope and contents may be sorted and read, if desired, by automated machines, and as to the parts of which the business may use a combination if impact and non-impact printers to print variable information on the parts prior to assembly, and use a relatively inexpensive sealer for assembling the parts into sets, three parts are provided. Of these, Part 2 at one stage forms a first face of a mailer and at another a second face of a return envelope; Part 1 at that other stage forms the first face of the return envelope and the flap for sealing the open end of the return envelope; and Part 3 at the one stage forms the second face of the mailer and, at the other stage, forms the remittance stub.

The principles of the invention will be further discussed with reference to the drawings wherein a preferred embodiment is shown. the specifics illustrated in the drawings are intended to exemplify, rather than limit, aspects of the invention as defined in the claims.

BRIEF DESCRIPTION OF THE DRAWINGS

In the Drawings

FIG. 5 is a schematic diagram showing collation of the stocks for Parts 1 and 2 to provide the Part ½ subassembly component for the business customer;

FIG. 6 is a schematic diagram showing production of stock for Part 3, to provide the Part 3 component for the business customer;

FIG. 7 is a schematic diagram of how the Part ½ and Part 3 components of the form are variably printed, sealed together and severed into units for mailing to customers by the business customer;

FIG. 8 is a transverse cross-sectional view of a unit of the form, with some exaggeration of thickness in order to illustrate certain details more clearly;

FIG. 9 is a rear perspective view of a unit of the form, after the consumer (following instructions), has torn away the four tear strips thus separating the remainder of Part 3 of the unit from the remainder of the Part ½ subassembly of the unit; and FIG. 10 is a perspective view illustrating consumer insertion of the remittance stub and check into the return envelope, and rotation of the sealing flap to the rear for sealingly closing the return envelope.

DETAILED DESCRIPTION

The business form to be described, and the process and apparatus for making it by preference uses conventional business form-making materials, individual process techniques and apparatus units, however conducted and organized in such a way as to create a unique product. For instance, no unusual paper stock, perforating technique or glue applying devices are required.

In order to help the reader to more easily understand the process and product which is described below, a single unit of a business form embodying principles of the present invention is shown in an exploded condition from the front in FIG. 1, and from the rear in FIG. 2.

Figures 1, 2:
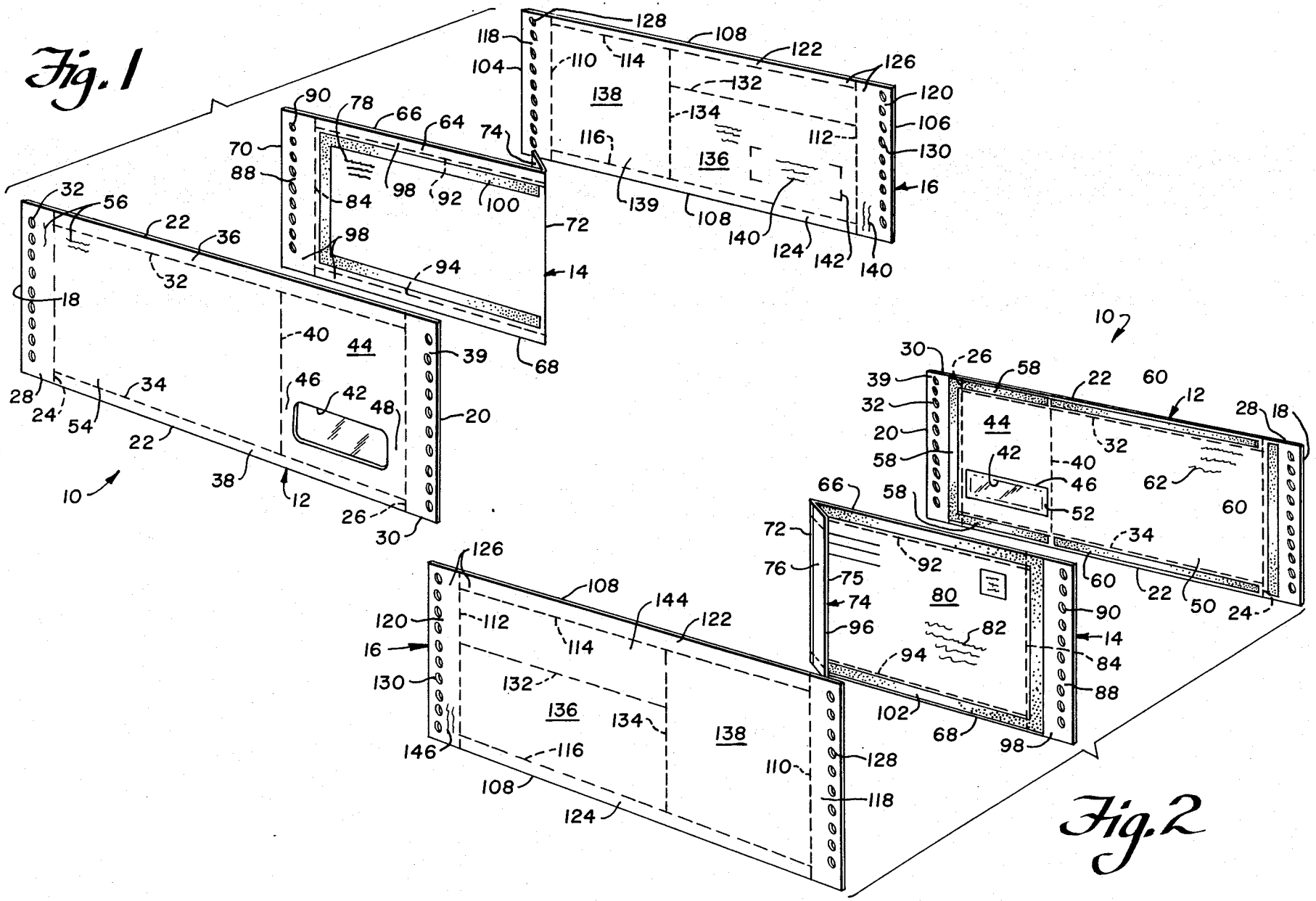
FIG. 1 is an exploded perspective view showing a corresponding one face of each of the three parts of a unit of a business form embodying principles of the present invention.
FIG. 2 is a similar exploded perspective view showing the other face of each of the three parts.

Referring to the orientation of the form in FIGS. 1 and 2, by convention, the left-to-right dimension of the form is designated its width, the top-to-bottom dimension its depth, and the front-to-back dimension its thickness.

From front to back in FIG. 1, and from back to front in FIG. 2, the respective parts of the form 10 are its Part 2 (designated 12), its Part 1 (designated 14), and its Part 3 (designated 16).

Part 2 in the illustrated, preferred embodiment, is shown being of full width and full depth and delimited between left and right marginal edges 18, 20, which extend longitudinally, and top and bottom severed perforation lines 22 forming corresponding marginal edges which extend transversally.

Full depth perforation lines are provided at 24 and 26 parallel and adjacent but spaced from the respective side marginal edges 18, 20, defining respective left and right marginal strips 28, 30. By preference, a line of drive sprocket tooth reception holes 32 extends longitudinally of the form on each (or at least one) of the marginal strips 28, 30.

Near but spaced from the top and bottom edges 22 of Part 2 of the form, transverse perforation lines 32, 34 are formed so as to intersect the perforation lines 24 and 26 and thus define top and bottom marginal strips 36, 38.

Collectively, the marginal strips 28, 30, 36 and 38 thus define a severable fully perimetrically extending marginal strip 39.

Intermediate its left and right marginal strips, but preferably located somewhat closer to one of them, Part 2 is shown provided with a longitudinally extending perforation line 40. The distance transversally of the form between the perforation line 40 and one of the left and right marginal strips 28 and 30 is, in the example, somewhat longer than the long dimension of a standard bank check of the type presently used by consumers in the United States of America for payment of bills (such checks being approximately 6.0 inches wide). And the distance transversally of the form between the perforation line 40 and the other of the left and right marginal strips is, in the same example, somewhat wider than a die-cut window 42 which is centered left-to-right in the respective panel 44 of Part 2 of the form 10.

The window 42 is shown being of rounded-corner rectangular outline wider-than-deep, and disposed nearer the lower than the upper margin of the form. The windows 42 preferably is of standard size and aspect ratio, e.g. so as to permit the display through it of a name, postal address and code line, (e.g. for expiration date, disk number, postal presort information or the like). A typical window aperture dimension is one inch by two and three-quarter inches.

It should be noticed that the distance transversally of the form, between the perforation line 40, and the nearest edge 44' of the windows, i.e. the window side margin 46 (and the window opposite side margin 48) is quite small, e.g. smaller than the depth dimension of a usual envelope-sealing flap.

The window 42 is shown in the example conventionally glazed by a sheet 46 of transparent flexible material, e.g. made of clear plastic packaging film such as cellophane, translucent glazed paper or the like. The glazing sheet is shown plated to the rear ("other") face 50 of the sheet 12 so as to cover the aperture and is secured in place by a ring of adhesive 52 which spacedly extends fully perimetrically of the aperture 42.

The front ("one") face 54 of the sheet 12 typically contains printed information 56, typically including the return address of the business, highlighting of perforation lines, instructions to the consumer for sequentially severing all four of the marginal strips, mailing class, postal permit indicia and the like.

The other face 50 of the sheet 12, in addition to the ring of adhesive 52 already described, is seen to include a square U-shaped strip of adhesive 58 which extends on the top and bottom and one side edge margin of the sheet 12 only on one side of the intermediate longitudinal perforation line 40, i.e. so that it spacedly arches around three sides of the window 42.

The remainder of the perimetrical strip of the sheet 12 on its other face 50 is shown provided with a squared U-shaped strip of adhesive 60. The two strips of adhesive 58 and 60 could be a continuation of one another and employ the same adhesive. However, by preference, the adhesive strip 58 is a hot-melt, remeltable adhesive, and the adhesive strip 60 is a paper paste, so that the latter may be put to work without danger of activating any of the former.

The other face 50 of the sheet 12 also may bear printing 62 and/or spots of "carbon" or carbonless ink-transfer coating material or the like as is in conventional use on mailers. Printing may include, for instance, instructions to sever the two main panels of the sheet 12 from one another along the perforation line 40 and/or contents-obscuring patterning for the inside of the return envelope (to be described).

The spots of ink transfer coating may be provided so that variable information may be applied to any other sheet or enclosure of the assembled form 10 by striking the front of the form, e.g. with a ribboned impact printer if the same information is to be displayed on the exterior of the front of the form, or with a ribbonless impact printer if that information is to be displayed on the inside of the form (e.g. on the front of the third sheet), but not be visibly printed on the outside of the form.

(Although the strip of adhesive 60, i.e., the paste, has been described above as if applied to the other face 50 of Part 2 (sheet 12) of the form, in practice, it could be applied to the corresponding site on the front ("one") face 64 of Part 1 (sheet 14) of the form, now to be described inasmuch as its purpose is to secure Parts 1 and 2 of the form 10 together along the respective squared U-shaped portions of their outer peripheral margins.)

Part 1 (sheet 14) of the form 10 is narrower than Part 2 (sheet 12). It is as deep, between its top and bottom edges 66 and 68, and it is as wide between one of its side margins 70 and a full depth perforation line 72 provided on it so as to coincide with the perforation line 40, on the opposite side of its perforation line 72, i.e. on the side which corresponds with the window-apertured panel of sheet 12, the sheet 14 has merely a preferably full depth, short flap panel 74.

The one face 64 of the flap 74 is shown provided with a full-depth strip of adhesive 75. This adhesive 75 could be of a conventional rewettable glue-type, although what is shown is a strip of two-sided pressure-sensitive adhesive-coated tape, the otherwise-active one face of which is protected by a full depth peelable cover strip 76.

In the form 10, the inactivated adhesive-coated flap 74 is doubled back along the perforation line 72 so that at this site only, the one face 64 of the sheet 14 faces towards the rear.

The one face 64 of the sheet 14 may be printed, e.g. at 78, with obscuring patterning for the interior of the return envelope (to be described), and, on its flap 74 or on the cover strip 76 with instructions for rotating the flap and activating its adhesive for closing and sealing the return envelope (to be described).

The sheet 14 may be printed on its rear "other" face 80, e.g. at 82 with the address of the business, lines of the consumer to enter his or her return address, indicia indicating where a postage strap is to be stuck (or business reply or franking, postal permit indicia or the like).

The sheet 14 near, but spaced from its side edge which is to coincide with an edge of the sheet 12 is provided with a full depth longitudinal perforation line 84 defining a side marginal strip 88 which is shown provided intermediate its width which a line 90 of drive sprocket-receiving holes. Near, but spaced from its to and bottom marginal edges the sheet 14 is shown provided with transverse perforation lines 92, 94 which extend between the perforation line 84 and the opposite side edge 96 of the strip 14. (Where the flap adhesive strip is inactivated by a full depth cover strip 76, the perforation lines 92, 94 extend through that cover strip, as well.)

The perforation lines 84, 92, 94 thus constitute a square U-shaped marginal strip 98 on the sheet 14.

The perforation lines 84, 92, 94 are so situated that when the sheets 12 and 14 are put together, to the extent that the sheets 12 and 14 are co-extensive, the perforation line 84, 92, 94 and peripheral strip 98 on the sheet 14 are coincident with corresponding ones of the perforation lines and the peripheral strip 39 of the sheet 12.

On its one face 64, the wide panel of the sheet 14 is provided so as to immediately inwardly (i.e. more centrally) border the marginal strip 98, with a squared U-shaped band of adhesive 100. (In practice, the band of adhesive 60 may be so broad that part of it is transected by the perforation lines 84, 92, 94 to also provide the band of adhesive 100.

On its other face 80, the marginal strip 98 of the sheet 14, except on the flap 74 is shown provided with a squared U-shaped strip of adhesive 102 which preferably is the same, e.g. remeltable hot-melt adhesive used for the adhesive strip 58 on the other face 50 of the sheet 12.

Part 3 (sheet 16) of the form 10 in the example has a width and depth equal to that of Part 2 (sheet 12) of the form, so that its left and right edges 104, 106 extend longitudinally, and its top and bottom edges 108 extend transversally, being likewise defined (as are the corresponding edges of Parts 1 and 2 of the form, by severed perforation lines).

At the left, right, top and bottom, spaced inwards, i.e. more centrally, from the respective edges, the sheet 16 is shown provided with perforation lines 110, 112, 114 and 116 defining marginal strips 118, 120, 122 and 124 which collectively constitute a fully perimetrically extending marginal strip 126. These features are so located that when the form 10 is assembled, the perforation lines 110, 112, 114 and 116 on the sheet 16 coincide with the perforation lines 28, 30, 36 and 38 on the sheet 12 and the respective marginal strips 39 and 126 coincide, with the marginal strip 98 (including its portions on the turned-back flap 74) sandwiched between them.

The marginal strips 122 and 124 are likewise provided intermediate their widths with longitudinal lines 128, 130 of drive sprocket pin-receiving holes. When the sheets 12, 14, 16 of the form are sub-assembled, or assembled corresponding holes in the corresponding rows on the respective sheets are aligned so as to form respective holes completely through the thickness of the form, so that a series of such forms may be driven and guided through various stations. On the individual sheets, these lines of holes are used for advancing webs of such sheets in series through various stations (to be described).

The sheet 16, Part 3 of the form 10, is shown further divided by internal transverse and longitudinal perforation lines 132, 134 into a plurality of further panels, preferably including a remittance stub 136 and a record of payment stub 138, both of such preferably have two edges formed by internal perforation lines 132, 134, and two edges formed by a respective two of the marginal strip-defining perforation lines 110, 112, 114 and 116.

The front ("one") face 139 of the sheet 16 may be preprinted, as at 140, with highlighting for the parts of the perforation lines 132, 134 which define corresponding parts of the perimeter of the remittance stub 136, with instructions for severing the remittance stub and return-mailing it with a check in the return envelope (to be described), with instructions for not folding the remittance stub and check when inserting them in the return envelope (to be described), for closing and sealing the flap 74 of the return envelope (to be described) a grid for the variable information 142 which is printed on the one face 139 of the sheet 16 and the like.

The rear ("other") face 144 of the sheet 16 may be printed, as at 146, e.g. with instructions to the consumer for detaching all four of the marginal strips of the form in sequence, just in case the consumer begins to open-up the mailer 10 from the back rather than from the front or in case such instructions are intentionally omitted from the front of the mailer. The central panel of the other face 144 of the sheet 16 may be blank, or carry an advertising message, or a printed pattern for obscuring from view externally of the mailer the variable information that is printed on the one face 139 of the sheet 16. The dimensions of the remittance stub 136 preferably are equal to those of a standard check used by consumers for paying bills (e.g. about 2.75×6.0 inches), or bears such size relation thereto as may be specified by ANSI or other standards-setting organizations so that it may be processed in an automated manner when received by the business in the return envelope from the consumer.

Manufacture of stock and components for the form 10 will now be described, primarily with reference to FIGS. 3–6.

Figure 3:
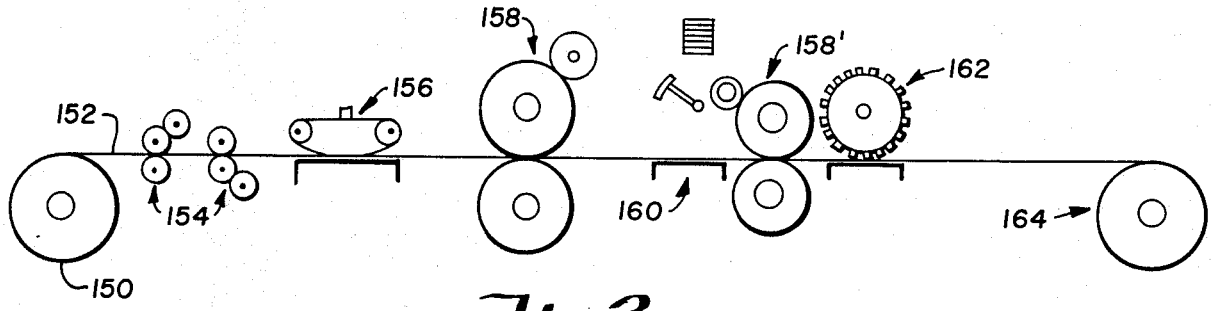
FIG. 3 is a schematic diagram showing production of stock for Part 2.

FIG. 3 shows an idealized, schematic form, steps in a sequence for producing a stock of Part 2 of the form 10 as a rolled web containing a continuous, (rather, indeterminate length) longitudinally extending series of the sheets 12.

In FIG. 3, a roll of paper is shown at 150 being unreeled to form a web 152 which is run through a printing press 154 to print the desired constant information on one or both faces of the web. In an instance where the sheets 12 are to have a window 42, it is die-cut at 156. Adhesive for fastening the window glazing in place is applied at 158, and then the window glazing is applied at 160. (This adhesive can be applied to the glazing rather than to the web 152, a should be apparent.) Further, the squared U-shaped marginal strip of business-activated adhesive 58 may be applied at 158, or, if it is a different adhesive from that used for adhering the window glazing, it may be applied at a further station.

Any perforation lines that are not essentially provided at a later stage may be applied at a perforating station 162, and the resulting web of plural Parts 2 in series rerolled at 164.

Figure 3A:
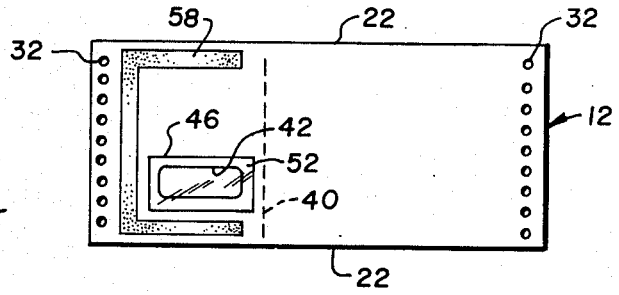
FIG. 3*a* is another side elevational view of one unit's worth of the stock produced in the FIG. 3 sequence of steps.

At this stage, each increment of the roll 164 which will become an individual Part 2 looks, from its rear, other face, as shown in elevation in FIG. 3*a* (although the perforation lines 22 may or may not yet have been formed, and the web will not yet have been severed into individual sheets along the perforation lines 22).

Figure 4:
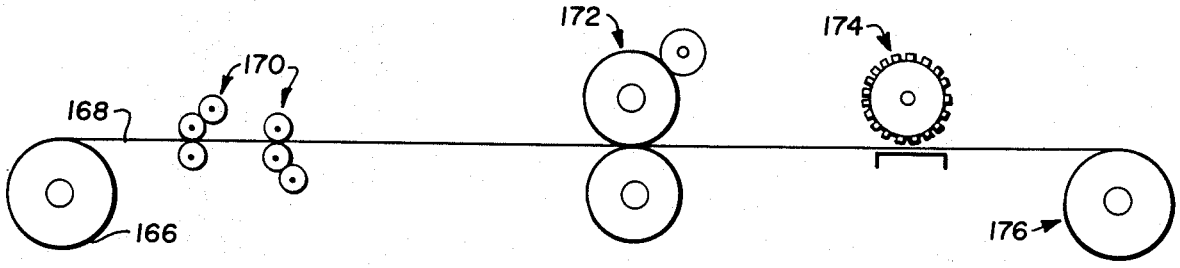
FIG. 4 is a schematic diagram showing production of stock for Part 1.

FIG. 4 shows an idealized, schematic form, steps in a sequence for producing a stock of Part 1 of the form 10 as a rolled web containing a continuous, longitudinally extending series of the sheets 14.

In FIG. 4, a roll of paper is shown at 166 being unreeled to form a web 168 which is run through a printing press 170 to print the desired constant information on one or both faces of the web.

Further, the squared U-shaped marginal strip of business-activated adhesive 102 is applied at 172.

Any perforation lines that are not essentially provided at a later stage may be applied at a perforating station 174, and the resulting web of plural Parts 1 in series rerolled at 176.

Figure 4A:
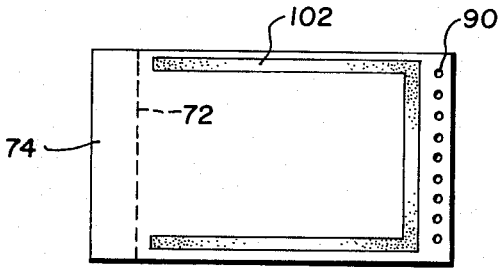
FIG. 4*a* is a one side elevational view of one unit's worth of the stock produced in the FIG. 4 sequence of steps.

At this stage, each increment of the roll 176 which will become an individual Part 1 looks, from its rear, other face, as shown in elevation in FIG. 4*a* (although the perforation lines which will define its top and bottom edges may or may not yet have been formed, and the web will not yet have been severed into individual sheets along those perforation lines).

FIG. 5 shows in idealized, schematic form, steps in a sequence for producing a stock of the first component of the form 10, as such component will be perceived by the business customer of the form manufacturer.

In FIG. 5, a roll 164 of the stock of Part 2 of the form, and a roll 176 of the stock of Part 1 of the form are shown being unrolled to provide respective webs 178, 180. At a pasting station 182, adhesive is applied to the other face of Part 2 (or to the one face of Part 1) in the pattern for strips 60 and 100 and the webs 178, 180 are brought together in a superimposed, registered, face-wise manner (recalling that only one side margin registers, because the web 180 is narrower than the web 178).

Next, a conventional plow folder and creaser 184 doubles over the strip of the web 180 that will form the flaps 74 of the successive sheets 14.

At 186 the adhesive means 188 is applied to the now rearwardly-facing one face of the flap strip 74. In the instance depicted, the adhesive means 188 is in the form of a roll of double-sided adhesive tape with a layer of cover strip material, this being a particularly quick and easy way to provide the inactivated adhesive of the flat strip 74. However, if desired, the flap strip adhesive could be applied as a rewettable glue (although, then, it must be dried before being allowed to touch any other part of the component.)

Finally, at a perforating station 190, all remaining perforations are provided through the first component comprising the composite Part ½ web 192 which is then collected at 194, e.g. in pad form ready for shipment in bulk to the business customer.

(For long or substantially continuous runs, the break illustrated between manufacture of stocks for Parts 1 and 2 as shown in FIGS. 3 and 4, and manufacture of the first component by lamination and further processing of stock for parts 1 and 2 as shown in FIG. 5 can be avoided, e.g. by passing the downstream ends of the webs from the FIGS. 3 and 4 sequences of steps to the sequence of steps shown in FIG. 5 without actually reeling, then unreeling these stocks, as should be apparent.)

FIG. 6 shows an idealized, schematic form, steps in a sequence for producing a stock of Part 3 of the form 10 as a padded web component containing a continuous (more precisely, indeterminate length) longitudinally extending series of the sheets 16.

In FIG. 6, a roll of paper is shown at 196 being unreeled to form a web 198 which is run through a printing press 200 to print desired constant information on one or both faces of the web 198. Perforation lines are applied at a perforating station 202, and the resulting web 204 of plural Parts 3 in series is padded at 206, ready for shipment in bulk to the business customer of the form manufacturer as the second component of the form 10.

It may be noticed that, by preference, the padded web 206 constituting the second component of the form 10 is adhesiveless, all of the adhesive needed for marrying the two components of the form 10 being provided, prferably as a remeltable, hot-melt adhesive, on the first component constituted by the padded, laminated web sub-assembly of plural Parts 1 and 2 of the form, as described above.

Typical intended usage of the form at the billing business will now be further described with reference to FIG. 7, in which a sequence is shown in idealized, schematic form.

At the business which is billing its consumer customers, or the like, stocks of the two components 194 and 206 are de-padded and fed to computer printers 208, 210 of impact and/or non-impact type which is used for printing variable (and sometimes constant) information on one or both sides of either or both components, in selected places, under the control of a conventional programmable printer-control computer 212. After printing, a succession of corresponding increments of the respective components are fed to a simple, conventional sealing mechanism 214, where under heat and pressure, the previously described hot-melt adhesive on the perimetrical strip on the back of the first component is adhered to the front of the perimetrical strip on the second component, and the resulting laminate separated into a succession of individual mailers 10 ready for mailing to consumers.

As can be seen by referring to FIG. 8, in laminating the two components together, the flap 74 with its inactivated strip of adhesive is caught in its double-over state. (Recall that the top and bottom marginal strip-defining perforations also pass through the flap 74 and its inactivated strip of adhesive.) Thus even through the flap 74 is so wide that, if it were not doubled over, it would partially obscure the information which is supposed to be visible through the window 42, the doubling-over and trapping of the flap 74 ensures that the desired information is sure to be exposed externally of the form 10, through the window 42. It is because of this novel feature that the return envelope (to be described) can be made long enough to receive a non-folded check and a non-folded remittance stub of machine-processable size, yet the overall width of the mailer 10 kept to a relatively small, standard width.

At the stage depicted in FIG. 9, a consumer addressee of the business which sent out the forms 10 has received one of them. By detaching the four composite marginal strips 216 along the superimposed respective perforation lines, as shown, he or she has thereby separated the form into a front portion 218, constituted by a united remainder of Parts 1 and 2 of the form, and rear portion 220 constituted by a remainder of Part 3 of the form. The latter portion is then further separated by the consumer into a remittance stub 136 and a remainder, e.g. including a record of payment stub 138.

Referring to FIGS. 9 and 10, the consumer then writes a check 222 for a requested amount, severs the panel 224 from the front portion 218 along the perforation line 40, thus creating from the remainder 226, a return envelope, the internal pocket 228 of which (FIG. 8) is at least slightly longer than the check 222 and the remittance stub 136.

Next, the consumer places the check 222 and the remittance stub 136 in the return envelope 226, activates the adhesive 75 on the flap 74 (e.g. by peeling-off the strip 76, where the adhesive is a pressure sensitive strip having its outer surface inactivated thereby, or by wetting the adhesive where the adhesive is a rewettable dried glue). Finally, the consumer rotates the flap 74 around the crease and/or perforation line 72 to stick the adhesive 66 and thus the flap 74 against the back panel 28 of the return envelope, and drops the thus filled, closed and sealed return envelope in the mail. In the mail, automated processing of the return envelope is facilitated, because no perforation lines, flaps or the like complicate the front surface of the return envelope, i.e. the surface bearing the stamp (or postal permit indicia) and the address.

At the business which receives the return envelope in the mail, automated processing also is facilitated, because the consumer's check and remittance stub can be extracted and machine read, e.g. by an OCR, without complications which may be otherwise caused by folded checks and/or remittance stubs.

It should now be apparent that the mailer including return envelope and remittance stub combined in outer envelope as described hereinabove, possesses each of the attributes set forth in the specification under the heading "Summary of the invention" hereinbefore. Because it can be modified to some extent without departing from the principles thereof as they have been outlined and explained in this specification, the present invention should be understood as encompassing all such modifications as are within the spirit and scope of the following claims.

I claim:

1. A mailer, comprising:

an inner envelope defined between two superimposed generally rectangular panels of sheet material having respectively joined marginal strips extending along adjacent three edges of each, one of these two panels having a fourth edge along which that one panel is not joined to the other, so that an at least potentially open mouth is provided for said inner envelope;

means defining a closure flap for said mouth of said inner envelope, said closure flap being foldably joined to said one panel along said fourth edge so that said closure flap may be externally overlapped with the other of said two panels;

a strip of activatable inactivated adhesive adapted, when activated, to secure said closure flap onto said other of said two panels in externally overlapped condition therewith, thereby sealingly closing said mouth of said inner envelope;

said other of said two panels, outwardly of said mouth, including an extension panel joined thereto along a line that with said fourth edge of said one panel defines said mouth of said inner envelope; and an outer envelope defined by:

said other of said two panels, and said extension panel together constituting a first member having a perimetrically extending margin having at least two opposite edges;

a second member comprising a sheet of material having a perimetrically extending margin having at least two opposite edges; and means severably connecting said margin of said first member along at least two of said opposite edges thereof to said margin of said second member along a corresponding at least two of said opposite edges thereof, with said second member covering at least a substantial portion of said one panel, including said mouth of said inner envelope, so that upon severing said connecting means and thereby disconnecting said second member from said first member, said extension panel may be displaced, said strip of adhesive actuated and urged into externally overlapping condition with said other of said two panels thereby sealingly closing said mouth of said inner envelope;

said flap being foldably joined to said fourth edge of said one panel for rotation substantilly 360 degrees about said fourth edge as an axis; and said flap being doubled-back upon said one panel and releasably held there by said second member so long as said second member is severably connected marginally thereof to said first member by said severable connecting means.

2. The mailer of claim 1, wherein:

said strip of activatable inactivated adhesive is provided on said flap.

3. The mailer of claim 1, wherein:

said strip of activatable inactivated adhesive is constituted by a strip of double-sided pressure-sensitive adhesive tape having an otherwise exposed surface removably covered by a peelable covering strip.

4. The mailer of claim 1, wherein:

said extension panel is severably joined to said other of said two panels along the respective said line, so that upon severing said connecting means and thereby disconnecting said second member from said first member, said extension panel may be displaced by severing it from said other panel.

5. The mailer of claim 1, wherein:

said extension panel has means defining a window therethrough, this window being spaced from said line along which said other panel and said extension panel are joined to one another by an amount which is less than the corresponding dimension of said flap.

6. The mailer of claim 5, wherein:

said inner envelope internally of said mouth provides a pocket which is at least six inches in greatest extent orthogonally of said edges of said one panel.

7. The mailer of claim 1, wherein:

said first member and said second member each having two pairs of orthogonally-related opposite edges extending along respective perimetrical margins thereof;

said margin of said second member being severably connected by said connecting means to said margin of said first member along all four of said edges of each of said members.

8. The mailer of claim 7, wherein:

said connecting means comprises adhesive strip means sandwiched between said first member and said second member.

9. The mailer of claim 8, wherein:

said connecting means further comprises fully perimetrically extending perforation line means bounded by said adhesive strip means such that when said margins of said first and second members are jointly severed from the remainder of said first and second members along said perimetrically extending perforation line means, said remainder of said first member is thereby detached from said remainder of said second member.

10. The mailer of claim 9, wherein:

said adhesive strip means is constituted by a substantially squared ring-shaped strip means of remeltable hot melt adhesive, including a first squared C-shaped portion provided on said one panel of said inner envelope and a second squared C-shaped portion provided on said extension panel, these two C-shaped portions opening towards one another with said flap being based between them on said one panel.

11. The mailer of claim 9, wherein:

said perimetrically extending perforation line means also extends across said flap in alignment with extension of such perforation line means along said margins of said first and second members of said first and second members, so that as said perforation line means is broken open to separate said margins jointly from said remainders, said flap is freed to rotate towards closing said mouth.

12. The mailer of claim 1, wherein:

said second member further comprises orthogonally related internal perforation line means defining with said perimetrically extending perforation line means a generally rectangular remittance stub panel sized, upon being severed from said remainder of said second member, to be received in said inner envelope through said mouth without needing to be folded.

13. The mailer of claim 12, wherein:

said extension panel has means defining a window therethrough, this window being spaced from said line along which said other panel and said extension panel are joined to one another by an amount which is less than the corresponding dimension of said flap.

14. The mailer of claim 13, wherein:

said inner envelope internally of said mouth provides a pocket which is at least six inches in greatest extent orthogonally of said edges of said one panel.

15. A two-component supply the components of which are assembleable with one another to constitute at least one mailer, each mailer of which will as a result of such assembly comprise:

an inner envelope defined between two superimposed generally rectangular panels of sheet material having respectively joined marginal strips extending along adjacent three edges of each, one of these two panels having a fourth edge along which that one panel is not joined to the other, so that an at least potentially open mouth is provided for said inner envelope;

means defining a closure flap for said mouth of said inner envelope, said closure flap being foldably joined to said one panel along said fourth edge so that said closure flap may be externally overlapped with the other of said two panels;

a strip of activatable inactivated adhesive adapted, when activated, to secure said closure flap onto said other of said two panels in externally overlapped condition therewith, thereby sealingly closing said mouth of said inner envelope;

said other of said two panels, outwardly of said mouth, including an extension panel joined thereto along a line that with said fourth edge of said one panel defines said mouth of said inner envelope; and an outer envelope defined by:

said other of said two panels, and said extension panel together constituting a first member having a perimetrically extending margin having at least two opposite edges;

a second member comprising a sheet of material having a perimetrically extending margin having at least two opposite edges; and means severably connecting said margin of said first member along at least two of said opposite edges thereof to said margin of said second member along a corresponding at least two of said opposite edges thereof, with said second member covering at least a sumbstantial portion of said one panel, including said mouth of said inner envelope, so that upon severing said connecting means and thereby disconnecting said second member from said first member, said extension panel may be displaced, said strip of adhesive actuated and urged into externally overlapping condition with said other of said two panels thereby sealingly closing said mouth of said inner envelope, wherein:

one of said two components is constituted by at least one said first member, and the other of said two components is constituted by at least one said second member, with said severable connecting means being provided in the form of activatable, inactivated adhesive strip means provided marginally along said at least two opposite edges of each said first member bounding perforation line means provided along said at least two opposite edges of at least one of said components, each said second member being characterized while maintained separate from a corresponding said first member by being substantially free of thermally activated adhesive such as has a tendency to adhere to non-impact printers which heat sheet material when applying non-impact printing thereto.

16. the two-component supply of claim 15, wherein;

said at least one first member is constituted by a longitudinally extending series of like first members with said other panel and extension panel of each being disposed in laterally adjoining relation and individual ones of said first members being severably joined to one another in said series thereof along perforation lines extending widthwise of this series.

17. The two-component supply of claim 16, wherein:

said at least one second member is constituted by a longitudinally extending series of like second members severably joined to one another in said series thereof along perforation lines extending widthwise of this series.

18. A two-component supply the components of which are assembleable with one another to constitute at least one mailer, each mailer of which will as a result of such assembly comprise:

an inner envelope defined between two superimposed generally rectangular panels of sheet material having respectively joined marginal strips extending along adjacent three edges of each, one of these two panels having a fourth edge along which that one panel is not joined to the other, so that an at least potentially open mouth is provided for said inner envelope;

means defining a closure flap for said mouth of said inner envelope, said closure flap being foldably joined to said one panel along said fourth edge so that said closure flap may be externally overlapped with the other of said two panels;

a strip of activatable inactivated adhesive adapted, when activated, to secure said closure flap onto said other of said two panels in externally overlapped condition therewith, thereby sealingly closing said mouth of said inner envelope;

said other of said two panels, outwardly of said mouth, including an extension panel joined thereto along a line that with said fourth edge of said one panel defines said mouth of said inner envelope; and an outer envelope defined by:

said other of said two panels, and said extension panel together constituting a first member having a perimetrically extending margin having at least two opposite edges;

a second member comprising a sheet of material having a perimetrically extending margin having at least two opposite edges; and means severably connecting said margin of said first member along at least two of said opposite edges thereof to said margin of said second member along a corresponding at least two of said opposite edges thereof, with said second member covering at least a sumbstantial portion of said one panel, including said mouth of said inner envelope, so that upon severing said connecting means and thereby disconnecting said second member from said first member, said extension panel may be displaced, said strip of adhesive actuated and urged into externally overlapping condition with said other of said two panels thereby sealingly closing said mouth of said inner envelope, wherein:

one of said two components is constituted by at least one said first member, and the other of said two components is constituted by at least one said second member, with said severable connecting means being provided in the form of activatable, inactivated adhesive strip means provided marginally along said at least two opposite edges of one of said components bounding perforation line means provided along said at least two opposite edges of at least one of said components;

said flap being foldably joined to said fourth edge of said one panel for rotation substantially 360 degrees about said fourth edge as an axis; and said flap being doubled-back upon said one panel and being adapted to be releasably held there by said second member when and for so long as said second member is severably connected marginally thereof to said first member by said severable connecting means.

19. The two-component supply of claim 18, wherein:

said activatable, inactivated adhesive strip means of said severable connecting means is provided on each said first member; each said second member being characterized while maintained separate from a corresponding said first member by being substantially free of thermally activated adhesive such as has a tendency to adhere to non-impact printers which heat sheet material when applying non-impact printing thereto.

20. The two-component supply of claim 19, wherein: said strip of activatable inactivated adhesive is provided on said flap.

21. The two-component supply of claim 19, wherein: said strip of activatable inactivated adhesive is constituted by a strip of double-sided pressure-sensitive adhesive tape having an otherwise exposed surface removably covered by a peelable covering strip.

22. The two-component supply of claim 19, wherein: said extension panel is severably joined to said other of said two panels along the respective said line, so that upon severing said connecting means and thereby disconnecting said second member from said first member, said extension panel may be displaced by severing it from said other panel.

23. The two-component supply of claim 19, wherein: said extension panel has means defining a window therethrough, this window being spaced from said line along which said other panel and said extension panel are joined to one another by an amount which is less than the corresponding dimension of said flap.

24. The two-component supply of claim 23, wherein: said inner envelope internally of said mouth provides a pocket which is at least six inches in greatest extent orthogonally of said edges of said one panel.

25. The two-component supply of claim 19, wherein: said first member and said second member each have two pairs of orthogonally-related opposite edges extending along respective perimetrical margins thereof;

said margin of said second member being adapted to be severably connected by said connecting means to said margin of said first member along all four of said edges of each of a respective said first member and a respective said second member.

26. The two-component supply of claim 25, wherein: said activatable, inactivated adhesive strip means of said severable connecting means of said severable connecting means is provided marginally of all four edges of the said one member on which it is provided; and said connecting means further comprises fully perimetrically extending perforation line means bounded by said adhesive strip means such that when said margins of said first and second members are jointly severed from the remainder of said first and second members along said perimetrically extending perforation line means, said remainder of said first member is thereby detached from said remainder of said second member.

27. The two-component supply of claim 26, wherein: said adhesive strip means is constituted by a substantially squared ring-shaped strip means of remeltable hot melt adhesive, including a first squared C-shaped portion provided on said one panel of said inner envelope and a second squared C-shaped portion provided on said extension panel, these two C-shaped portions opening towards one another with said flap being based between them on said one panel.

28. the two-component supply of claim 26, wherein: said perimetrically extending perforation line means also extends across said flap in alignment with extension of such perforation line means along said margins of said first and second members of said first and second members, so that as said perforation line means is broken open to separate said margins jointly from said remainders, said flap is freed to rotate towards closing said mouth.

29. The two-component supply of claim 19, wherein: said second member further comprises orthogonally related internal perforation line means defining with said perimetrically extending perforation line means a generally rectangular remittance stub panel sized, upon being severed from said remainder of said second member, to be received in said inner envelope through said mouth without needing to be folded.

30. The two-component supply of claim 29, wherein: said extension panel has means defining a window therethrough, this window being spaced from said line along which said other panel and said extension panel are joined to one another by an amount which is less than the corresponding dimension of said flap.

31. The two-component supply of claim 30, wherein: said inner envelope internally of said mouth provides a pocket which is at least six inches in greatest extent orthogonally of said edges of said one panel.

* * * * *